US006616812B2

(12) United States Patent
Beck

(10) Patent No.: US 6,616,812 B2
(45) Date of Patent: Sep. 9, 2003

(54) ANTI-REWET FELT FOR USE IN A PAPERMAKING MACHINE

(75) Inventor: David A. Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/964,720

(22) Filed: Sep. 27, 2001

(65) Prior Publication Data

US 2003/0056925 A1 Mar. 27, 2003

(51) Int. Cl.[7] ..... D21F 3/04; D21F 7/08

(52) U.S. Cl. ..... 162/358.2; 162/206; 162/900; 428/137; 442/286; 34/115; 100/121

(58) Field of Search ..... 162/199, 205, 162/206, 348, 358.1, 358.2, 358.3, 358.5, 360.3, 359.1, 900, 902, 903; 139/383 A, 425 A; 34/111, 115, 116, 122, 123; 100/155 R, 118, 121; 28/107, 110; 428/131, 137, 138; 442/286–294

(56) References Cited

U.S. PATENT DOCUMENTS 1,536,533 A * 5/1925 Sheehan ..... 139/383 A
3,399,111 A * 8/1968 Beaumont et al. ..... 156/73.1
3,617,442 A * 11/1971 Hurschman ..... 162/212
4,173,249 A * 11/1979 Holkko et al. ..... 162/360.1
4,541,895 A * 9/1985 Albert ..... 162/348
4,675,079 A * 6/1987 Webster ..... 162/360.1
4,772,504 A * 9/1988 Andresen ..... 162/205
5,232,768 A * 8/1993 Eklund et al. ..... 139/383 A
5,328,757 A * 7/1994 Kenney et al. ..... 428/304.4
5,925,221 A * 7/1999 Sayers et al. ..... 162/902
6,030,908 A * 2/2000 Baker et al. ..... 139/383 R
6,103,062 A * 8/2000 Ampulski et al. ..... 162/109
6,140,260 A * 10/2000 Johnson et al. ..... 139/383 A
6,159,880 A * 12/2000 Schiel ..... 162/358.2
6,436,240 B1 * 8/2002 Jeffrey ..... 162/358.2

* cited by examiner

*Primary Examiner*—Steven P. Griffin
*Assistant Examiner*—Eric Hug
(74) *Attorney, Agent, or Firm*—Taylor & Aust, P.C.

(57) ABSTRACT

An anti-rewet fabric is used for carrying a fiber web through an air press. The anti-rewet fabric includes at least one air distribution fabric layer, one air distribution fabric layer being configured for contacting the fiber web, and a perforated film layer, the perforated film layer being made of a polyester film. The perforated film layer has a first film side and a second film side, the first film side being one of laminated and attached to the one air distribution fabric layer.

31 Claims, 3 Drawing Sheets

ANTI-REWET FELT FOR USE IN A PAPERMAKING MACHINE

STATEMENT REGARDING FEDERALLY SPONSORED RESEARCH OR DEVELOPMENT

This invention was made with Government support under Prime Contract No. DE-FC36-01GO10622 awarded by the Department of Energy. The Government has certain rights in this invention.

BACKGROUND OF THE INVENTION

1. Field of the Invention

The present invention relates to fabrics used in papermaking machines, and, more particularly, to fabrics used to carry fiber or, more particularly, paper webs through a drying press.

2. Description of the Related Art

For many years attempts have been made to use external air pressure to force water out of a paper web. Rather than compress a sheet at a press nip to the point where hydraulic pressure drives water out, as is the case in normal wet pressing, it was reasoned that more water could be removed, and sheet bulk could be maintained, if air pressure could be applied to supplement roller nip generated hydraulic pressures. One such attempt involves providing a multi-roller or other structure forming an air press having a closed chamber, wherein air is circulated through the chamber to convect moisture out of the paper web. Such air presses typically carry the paper web sandwiched between an upper pressing fabric and a lower anti-rewet layer.

Much attention has been given to the design of the pressing fabric and its characteristics. The construction of the pressing fabric has been thought to be the most important of the above-mentioned fabrics since it controls mechanical pressure on the paper web and the air flow therethrough. However, experimentation has shown the importance of the underneath anti-rewet layer. It has been found that rewet can have a profound effect on sheet solids after pressing. Specifically, the quality of the paper web has been found to decrease with increasing rewet. Sheet rewet can be controlled by the design of the anti-rewet layer.

What is needed in the art is an anti-rewet layer for use in air presses which can effectively minimize the amount of rewet which occurs in a fiber web during and after pressing thereof in a drying press.

SUMMARY OF THE INVENTION

The present invention provides an anti-rewet fabric or felt that includes at least one air distribution layer laminated or otherwise attached to a perforated film layer, the anti-rewet fabric having a low enough permeability so that water cannot be attracted back into a fiber web carried thereby through an air press.

The invention comprises, in one form thereof, an anti-rewet felt for carrying a fiber web through an air press. The anti-rewet felt includes at least one air distribution layer, one air distribution layer being configured for contacting the fiber web, and a perforated film layer, the perforated film layer being made of a polyester film. The perforated film layer has a first film side and a second film side, the first film side being one of laminated and attached to the one air distribution layer.

In another form thereof, the invention comprises a papermaking machine for making a fiber web. The papermaking machine includes a plurality of conveyor rolls for carrying the fiber web and first and second opposing press elements. The first press element and the second press element together form a nip therebetween. The papermaking machine further includes at least a first anti-rewet layer configured for carrying the fiber web through the nip. The first anti-rewet felt includes at least one air distribution fabric layer, one air distribution fabric layer being configured for contacting the fiber web, and a perforated film layer, the perforated film layer being made of a polyester film. The perforated film layer has a first film side and a second film side, the first film side being one of laminated and attached to the one air distribution fabric layer, the second film side being directed toward one press element.

In another form thereof, the invention comprises a method of conveying a fiber web into an air press, the air press having a nip. The method includes the step of providing an anti-rewet felt for carrying the fiber web through an air press. The anti-rewet felt includes at least one air distribution fabric layer configured for contacting the fiber web and a perforated film layer, the perforated film layer being made of a polyester film. The perforated film layer has a first film side and a second film side, the first film side being one of laminated and attached to one the air distribution fabric layer. The method further includes the step of carrying the fiber web on one air distribution fabric layer of the anti-rewet felt into the air press through the nip.

An advantage of the present invention is rewet of the fiber web after water has been removed therefrom can be greatly minimized.

A further advantage is that the perforated film layer of the anti-rewet felt or fabric increases the average air flow path length through the fabric.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
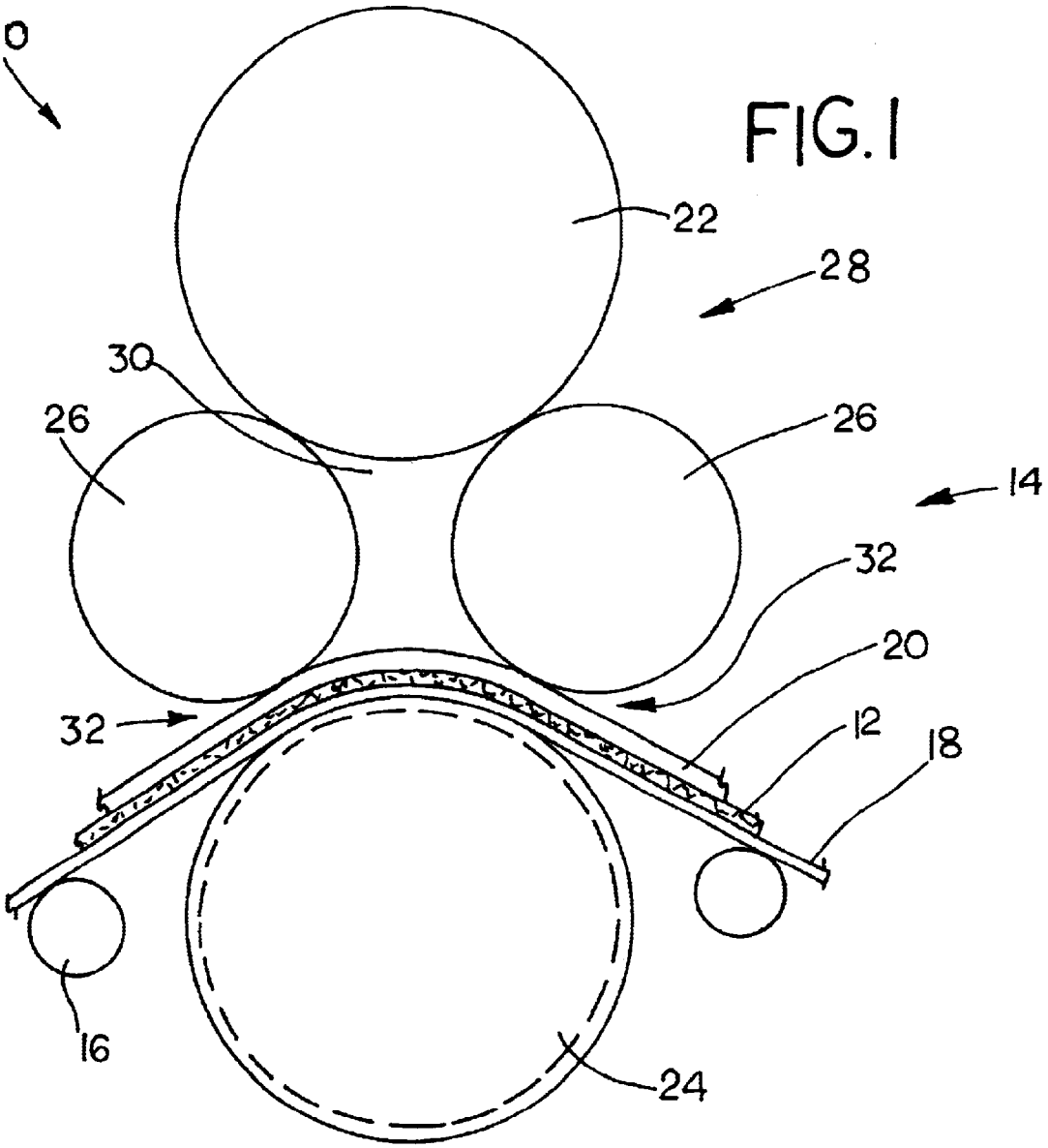
FIG. 1 is a side view of a first embodiment of a papermaking machine of the present invention.

Corresponding reference characters indicate corresponding parts throughout the several views. The exemplifications set out herein illustrate at least one preferred embodiment of the invention, in one form, and such exemplifications are not to be construed as limiting the scope of the invention in any manner.

DETAILED DESCRIPTION OF THE INVENTION

Referring now to the drawings, and more particularly to FIG. 1, there is shown a papermaking machine 10 for forming a fiber web 12 which generally includes an air press 14, a plurality of conveyor rolls 16, a first fabric 18 and a second fabric 20.

Air press 14 includes a first main roll 22, a second main roll 24, and a pair of cap rolls 26. First main roll 22 and cap rolls 26 together define an enclosure 28. Second main roll 24 acts as a counter element for enclosure 28. Enclosure 28 and second main roll 24 conjunctively define air press chamber 30 with air press chamber 30 having a pressurized fluid or gas (e.g., air, steam or a heated gas) therein. Second main roll 24 coacts with each of cap rolls 26 to define a pair of nips 32 through which first fabric 18, second fabric 20 and paper web 12 are conveyed. Second main roll 24 is a vented roll, a vented roll being a roll that is at least one of vented, grooved, blind drilled, drilled, and connected to a source of suction in order to promote drainage therethrough.

Conveyor rolls 16 and second main roll 24 together carry first fabric 18, second fabric 20 and paper web 12 to, through and beyond air press 14. First fabric 18 is positioned between paper web 12 and second main roll 24, while second fabric 20 is arranged between paper web 12 and air press chamber 30.

Figure 2:
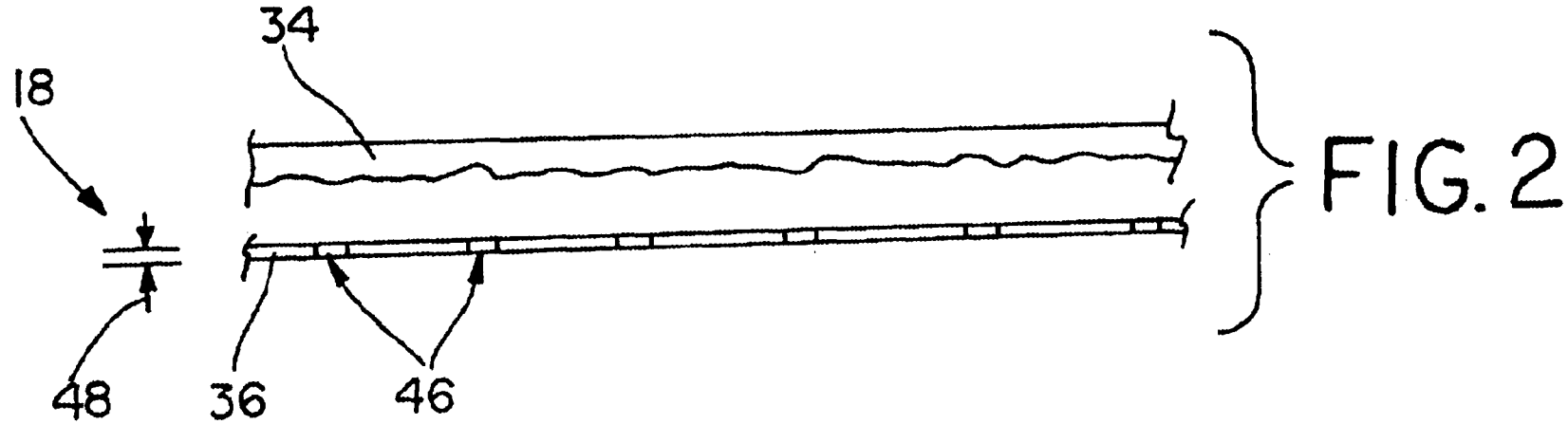
FIG. 2 is a schematic, exploded side view of the first fabric shown in FIG. 1.

First fabric 18 is an anti-rewet fabric or felt and is at least a two-layer fabric. First fabric 18 is designed so that water can not be readily attracted back into fiber web 12 by web sheet expansion or web sheet capillary forces. First fabric 18 includes at least one air distribution fabric layer 34 (FIG. 2) and a perforated film layer 36, one air distribution fabric layer 34 being configured for contacting fiber web 12. Conversely, perforated film layer 36 should always be kept away from paper web 12 so as to not adversely affect the paper forming process. As an anti-rewet fabric, first fabric 18 is configured for promoting a one-way flow of water therethrough, allowing first fabric 18 to be used to direct the flow of water away from fiber web 12.

Figure 4:
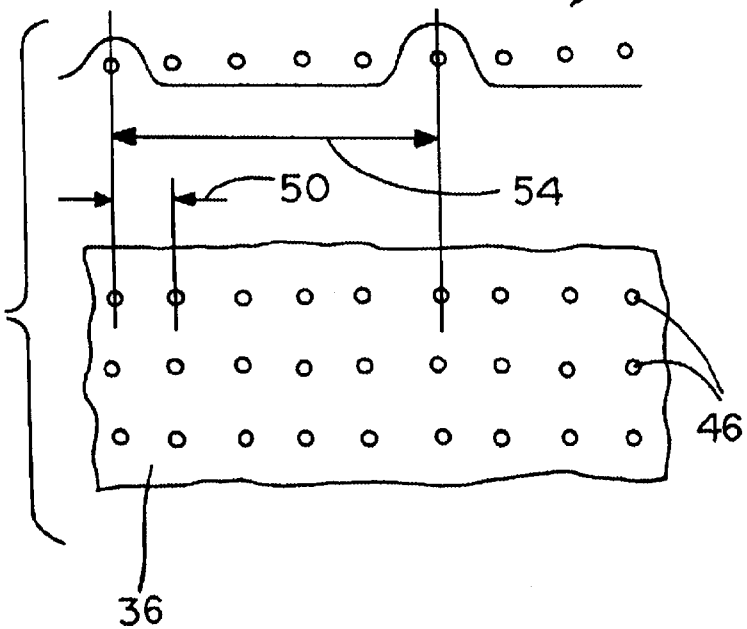
FIG. 4 is a schematic, exploded view of a second embodiment of the first fabric shown in FIG. 2.
Figure 3:
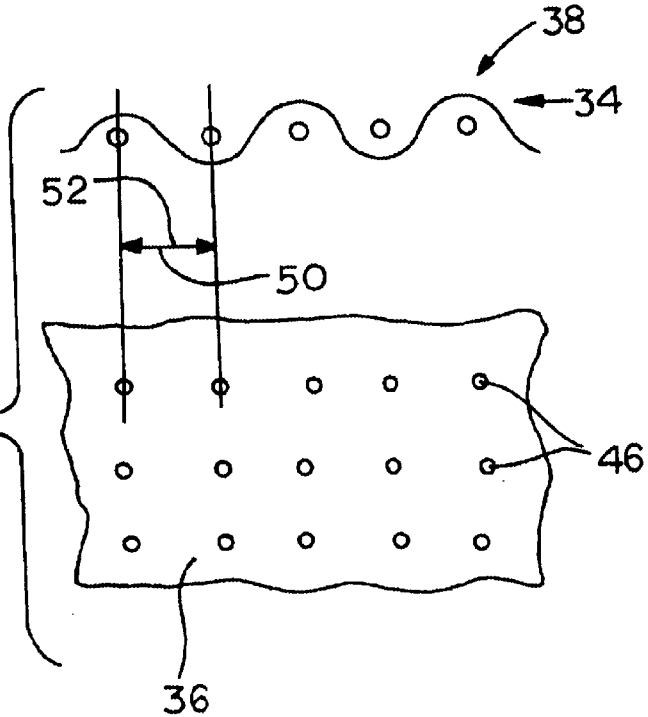
FIG. 3 is a schematic, exploded view of a first embodiment of the first fabric shown in FIG. 2.

Each air distribution fabric layer 34 is advantageously a polyester fabric and a sateen fabric favorably. A plain weave 38 (FIG. 3) may be used for each air distribution fabric layer 34, but a multi-float weave 40 (FIG. 4) is much preferred. Multi-float weave 40 is also known as a multi-shed weave with a five-shed weave, in particular, being illustrated in FIG. 4. Multi-float weave 40 is preferred because such a weave provides for a longer flow path of air and thereby has a higher distribution effect associated therewith. Alternatively, each air distribution layer 34 may be formed of a non-woven fabric, so long as such fabric spreads the air sufficiently. One air fabric layer 34 found to be favorable has a sateen weave, a thickness of about 0.022 inches, a hole pattern of about 300 holes/sq. inch and an open area of about 19%, resulting in an air permeability of about 40 cfm.

Air distribution fabric layer 34 adjacent paper web 12 is favorably a fabric that holds low amounts of water and provides adequate airflow and fabric dewatering. The more resistive such air distribution fabric layer 34 is to airflow, the more back pressure there is, and, hence, the less water is removed from paper web 12. It is desired not to impede the flow of water out of paper web 12, so the permeability of the materials used for such air distribution fabric layer 34 should be high enough to provide for adequate fabric dewatering. If the permeability thereof is too high, however, the sheet side of air distribution fabric layer 34 will not dewater well since air will take short circuit paths therethrough, leaving water therein.

Perforated film layer 36 favorably is a polyester film (e.g., a film of material sold under the trade name "Mylar"®)or a plastic film and has a first film side 42 and a second film side 44. First film side 42 is one of laminated and attached to air distribution fabric layer 34 configured for contacting fiber web 12. Perforated film layer 36 has a plurality of perforate holes 46 formed therein. Perforated film layer 36 preferably includes more than about 40,000 holes/$m^2$ and more preferably more than about 200,000 holes/$m^2$, thereby resulting in an open area in the approximate range of 1 to 30%, preferably 5 to 15%. Perforated film layer 36 preferably has a film thickness 48 of less than about 0.04 inches and ideally less than about 0.005 inches.

In perforated film layer 36, each set of most-closely spaced perforate holes 46 is separated by a perforate distance 50. Additionally, each air distribution fabric layer 34 has one of plain weave 38 and a multi-float weave 40 associated therewith, plain weave 38 having a plain weave repeat distance 52 and multi-float weave 40 having a multi-float weave repeat distance 54. In order to maximize air distribution, plain weave repeat distance 52 and multi-float weave repeat distance 54 each are preferably at least substantially equal to and, most preferably, greater than perforate distance 50. In fact, the weave pattern chosen for each air distribution fabric layer 34 favorably should spread air further than perforate distance 50. As such, long floats in the weave pattern promote good spreading. In the embodiments illustrated in FIGS. 3 and 4, plain weave repeat distance 52 is equal to perforate distance 50, and multi-float weave repeat distance 54 is greater than perforate distance 50.

First fabric 18 works as an anti-rewet layer because the air pressure forces water in paper web 12 and first fabric 18 to pass through perforate holes 46, with the water then being deposited on the side of perforate film layer 36 facing away from paper web 12. The flow of air also causes a break in the contact between this water, paper web 12 and air distribution fabric layer 34 adjoining paper web 12. Because of this break, water is not attracted back in air distribution fabric layer 34 by capillary forces to rewet paper web 12. It is necessary to have adequate space for the water to reside after it passes through perforate holes 46, so the open area (not labeled) of perforate film layer 34 and the perforate hole size can not be too big.

Figure 5:
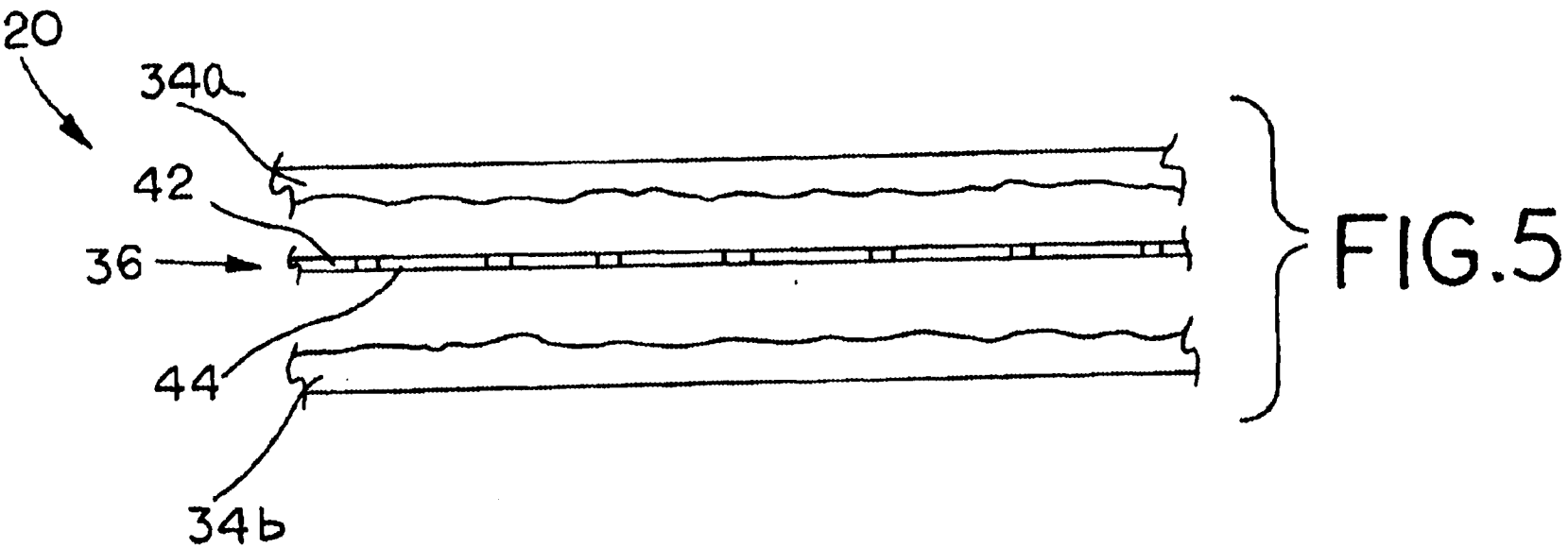
FIG. 5 is a schematic, exploded side view of the second fabric shown in FIG. 1.

Second fabric 20 is advantageously an anti-rewet fabric or felt of similar construction and properties as first fabric 18 except for certain features discussed herein. Second fabric 20 favorably acts as a transfer fabric for transferring fiber web 12 to a next station (not shown) of papermaking machine 10. Second fabric 20, as seen from FIG. 5, is a three-layer fabric having two air distribution fabric layers 34*a* and 34*b* as well as perforated film layer 36. Air distribution fabric layers 34*a* and 34*b* are attached to first film side 42 and second film side 44 of perforated film layer 36, respectively. First fabric 18 and second fabric 20 have a first permeability and a second permeability, respectively, the first permeability being equal to or greater than the second permeability. Choosing first fabric 18 and second fabric 20 such that the first permeability is greater than the second permeability can be advantageous as that situation would promote a net fluid flow toward vented second main roll 24, rather than toward air press chamber 30. Second fabric 20 need not be an anti-rewet layer to achieve adequate results. Second fabric 20 could instead, for example, be a permeable material.

Second fabric 20 could be used in lieu of first fabric 18 in a design in which only one such fabric is used. An advantage of the three-layer fabric design of second fabric 20 is that the presence of both of air distribution fabric layers 34*a* and 34*b* would allow one of such layers to be facing vented second main roll 24 and the other to carry paper web 12. The one of air distribution fabric layers 34*a* and 34*b* facing vented second main roll 24 would aid diffusion of air as it would pass beyond perforated film layer 36 to the vented areas of second main roll 24. Such aid in air diffusion would help ensure uniform air flow and minimize the opportunity of non-vented portions of second main roll 24 of blocking off airflow through second fabric 20.

Advantageously, at least one of first fabric 18 and second fabric 20 is an embossed imprinting fabric that is able to give fiber web 12 a three-dimensional structure such as raised or indented lettering and/or an embossed decorative design. The presence of a three-dimensional structure is advantageous in the production of towel tissue in a tissue paper machine, helping to increase the water absorbency capacity and rate. Preferably, first fabric 18 would be an imprinting fabric.

In operation, fiber web 12 is carried between first fabric 18 and second fabric 20 into one nip 32 of air press 14 by conveyor roll 16. Once inside air press chamber 30 of air press 14, the air pressure within air press chamber 30, as well as the mechanical pressure exerted at each of nips 32, forces water out of fiber web 12 as it is conveyed upon second main roll 24. Since first fabric 18 and second fabric 20 are anti-rewet felts or fabrics, the water forced out of fiber web 12 is substantially unable to return to and thus rewet fiber web 12. Fiber web 12 is conveyed out of air press 14 through another nip 32 toward a further conveyor roll 16. Conveyor roll 16 helps propel fiber web 12 toward a next processing station (not shown).

Figure 6:
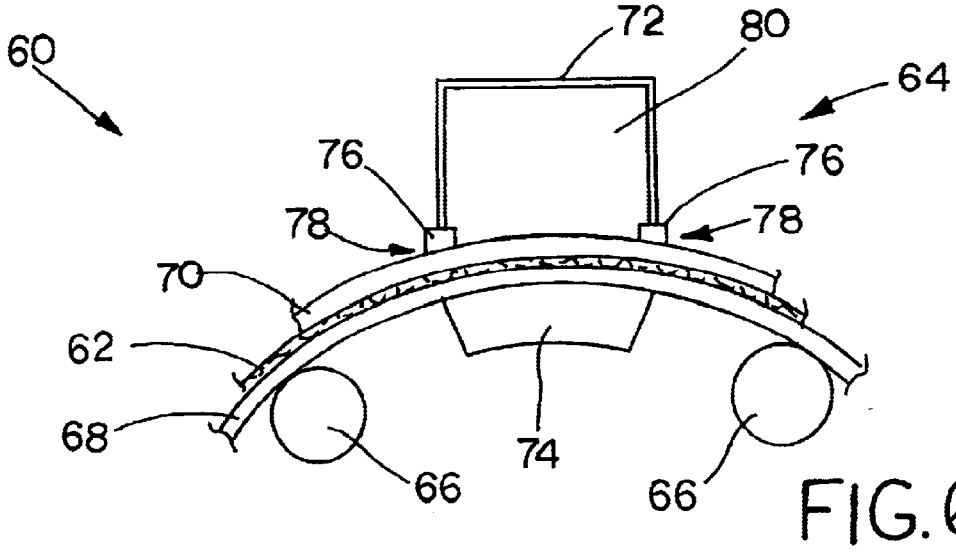
FIG. 6 is a side view of a second embodiment of a papermaking machine of the present invention.

A second embodiment of a papermaking machine is shown in FIG. 6. Papermaking machine 60 for forming a fiber web 62 which generally includes an air press 64, a plurality of conveyor rolls 66, a first fabric 68 and a second fabric 70. Papermaking machine 60 differs from papermaking machine 10 with respect to the air press employed by each. Consequently, only those features related to air press 64 and the operation thereof are discussed in any detail with respect to this embodiment.

Air press 64 includes a box enclosure 72 and an adjacently positioned counter element 74. Counter element 74 is a shoe, a vented box or a suction box (such terms often being used somewhat interchangeably in the art). Box enclosure 72 has a plurality of seals 76 mounted thereon adjacent counter element 74. Seals 76 of box enclosure 72 and counter element 74 together define a plurality of nips 78 through which fiber web 62, first fabric 68 and second fabric 70 are able to pass. Box enclosure 72 and counter element 74 together define air press chamber 80. Air press chamber 80, like air press chamber 30, has a pressurized fluid therein.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A press unit for dewatering a fiber web, said press unit comprising:

first and second opposing press elements, said first press element and said second press element together forming a nip therebetween;

at least one anti-rewet fabric configured for carrying the fiber web through said nip, each said anti-rewet fabric having a first fabric side and a second fabric side, each said anti-rewet fabric including:

at least one air distribution fabric layer, one air distribution fabric layer being configured for contacting the fiber web;

a perforated film layer, said perforated film layer being comprised of one of a polyester film and a plastic film, said perforated film layer defining a plurality of holes therethrough separated from each other by a perforate distance, said perforated film layer having a first film side and a second film side, said first film side being one of laminated and attached to said one air distribution fabric layer, said second film side being directed toward one of said first and second press elements; and said air distribution fabric layer being structured and arranged with said perforated film layer to spread air in said air distribution fabric layer a distance greater than said perforate distance.

2. The press unit of claim 1, wherein said first press element is an enclosure, said second press element being a counter element positioned opposite said enclosure, said second film side being directed toward said counter element.

3. The press unit of claim 2, wherein said enclosure contains a pressurized fluid.

4. The press unit of claim 3, wherein said pressurized fluid is at least one of air, steam and a heated gas.

5. The press unit of claim 2, wherein said enclosure includes three juxtaposed rolls and said counter element is a fourth roll further juxtaposed to said three juxtaposed rolls of said enclosure, said press unit thereby defining a four-roll press arrangement.

6. The press unit of claim 2, wherein said enclosure is a box having a pressurized fluid therein and said counter element is one of a roll, a shoe and a suction box.

7. The press unit of claim 2, wherein said counter element is one of a roll, a shoe, a vented box and a suction box.

8. The press unit of claim 7, wherein said counter element is a roll, said roll being at least one of vented, grooved, blind drilled, drilled, and connected to a source of suction.

9. The press unit of claim 2, wherein said at least one anti-rewet fabric includes a first anti-rewet fabric, said press unit further comprising a second fabric, said first anti-rewet fabric being configured so as to be arranged between the fiber web and said counter element, said second fabric being configured so as to be arranged between the fiber web and said enclosure.

10. The press unit of claim 9, wherein said first anti-rewet fabric and said second fabric have a first permeability and a second permeability, respectively, said first permeability being one of equal to and greater than said second permeability.

11. The press unit of claim 9, wherein said second fabric is an anti-rewet fabric, said second fabric including a first air distribution fabric layer and a second air distribution fabric layer, said first air distribution fabric layer being one of laminated and attached to said first film side and said second air distribution fabric layer being one of laminated and attached to said second film side.

12. A press unit for dewatering a fiber web, said press unit comprising:

first and second opposing press elements, said first press element and said second press element together forming a nip therebetween;

at least one anti-rewet fabric configured for carrying the fiber web through said nip, each said anti-rewet fabric having a first fabric side and a second fabric side, each said anti-rewet fabric including:

at least one air distribution fabric layer, one air distribution fabric layer being configured for contacting the fiber web; and a perforated film layer, said perforated film layer being comprised of one of a polyester film and a plastic film, said perforated film layer having a first film side and a second film side, said first film side being one of laminated and attached to said one air distribution fabric layer, said second film side being directed toward one of said first and second press elements;

wherein said first press element is an enclosure, said second press element being a counter element positioned opposite said enclosure, said second film side being directed toward said counter element; said at least one anti-rewet fabric includes a first anti-rewet fabric, said press unit further comprising a second fabric, said first anti-rewet fabric being configured so as to be arranged between the fiber web and said counter element, said second fabric being configured so as to be arranged between the fiber web and said enclosure; and the press unit is part of a papermaking machine, said second fabric being configured for transferring the fiber web to a next station of said papermaking machine.

13. An anti-rewet fabric for carrying a fiber web through an air press, the anti-rewet fabric comprising:

at least one air distribution fabric layer, one said air distribution fabric layer being configured for contacting the fiber web;

a perforated film layer, said perforated film layer being comprised of one of a polyester film and a plastic film, said perforated film layer defining a plurality of holes therethrough separated from each other by a perforate distance, said perforated film layer having a first film side and a second film side, said first film side being one of laminated and attached to said one said air distribution fabric layer; and said air distribution fabric layer being structured and arranged with said perforated film layer to spread air in said air distribution fabric layer a distance greater than said perforate distance.

14. The anti-rewet fabric of claim 13, wherein each said air distribution fabric layer includes one of a plain weave and a multi-float weave.

15. The anti-rewet fabric of claim 13, each said air distribution fabric layer having a fabric weave associated therewith, said fabric weave having a weave repeat distance, said weave repeat distance being one of equal to and greater than said perforate distance.

16. The anti-rewet fabric of claim 13, wherein said perforated film layer has a series of perforate holes therein, said perforated film layer having about at least 40,000 holes/$m^2$.

17. The anti-rewet fabric of claim 16, wherein said perforated film layer has a series of perforate holes therein, said perforated film layer having about at least 200,000 holes/$m^2$.

18. The anti-rewet fabric of claim 13, wherein said perforated film layer has an open area in the approximate range of 1% to 30%.

19. The anti-rewet fabric of claim 18, wherein said perforated film layer has an open area in the approximate range of 5% to 15%.

20. The anti-rewet fabric of claim 13, wherein said perforated film layer has a thickness of less than about 0.04 inches.

21. The anti-rewet fabric of claim 20, wherein said perforated film layer has a thickness of less than about 0.005 inches.

22. The anti-rewet fabric of claim 13, including a first air distribution fabric layer and a second air distribution fabric layer, said first air distribution fabric layer being one of laminated and attached to said first film side and said second air distribution fabric layer being one of laminated and attached to said second film side.

23. The anti-rewet fabric of claim 13, wherein each air distribution fabric layer is made of a sateen fabric.

24. An anti-rewet fabric for carrying a fiber web through an air press, the anti-rewet fabric comprising:

at least one air distribution fabric layer, one said air distribution fabric layer being configured for contacting the fiber web; and a perforated film layer, said perforated film layer being comprised of one of a polyester film and a plastic film, said perforated film layer having a first film side and a second film side, said first film side being one of laminated and attached to said one said air distribution fabric layer;

wherein each said air distribution fabric layer includes a multi-float weave.

25. An anti-rewet fabric for carrying a fiber web through an air press, the anti-rewet fabric comprising:

at least one air distribution fabric layer, one said air distribution fabric layer being configured for contacting the fiber web; and a perforated film layer, said perforated film layer being comprised of one of a polyester film and a plastic film, said perforated film layer having a first film side and a second film side, said first film side being one of laminated and attached to said one said air distribution fabric layer;

wherein said perforated film layer has a series of perforate holes therein, each set of most-closely spaced perforate holes being separated by a perforate distance, each said air distribution fabric layer having a fabric weave associated therewith, said fabric weave having a weave repeat distance, said weave repeat distance being greater than said perforate distance.

26. A method of conveying a fiber web into an air press, said air press having a nip, said method comprising the steps of:

providing an anti-rewet fabric for carrying the fiber web through said air press, said anti-rewet fabric comprising:

at least one air distribution fabric layer configured for contacting the fiber web;

a perforated film layer, said perforated film layer being comprised of one of a polyester film and a plastic film, said perforated film layer defining a plurality of holes therethrough separated from each other by a perforate distance, said perforated film layer having a first film side and a second film side, said first film side being one of laminated and attached to one said air distribution fabric layer; and said air distribution fabric layer being structured and arranged with said perforated film layer to spread air in said air distribution fabric layer a distance greater than said perforate distance; and carrying the fiber web on one said air distribution fabric layer of said anti-rewet fabric into said air press through said nip; and spreading air in said air distribution fabric layer a distance greater than said perforate distance.

27. A papermaking machine for making a fiber web, said papermaking machine comprising:

a plurality of conveyor rolls for carrying the fiber web;

first and second opposing press elements, said first press element and said second press element together forming a nip therebetween;

at least a first anti-rewet fabric configured for carrying the fiber web through said nip, said first anti-rewet fabric including:

at least one air distribution fabric layer, one said air distribution fabric layer being configured for contacting the fiber web; and a perforated film layer, said perforated film layer being comprised of one of a polyester film and a plastic film, said perforated film layer defining a plurality of holes therethrough separated from each other by a perforate distance, said perforated film layer having a first film side and a second film side, said first film side being one of laminated and attached to said one said air distribution fabric layer, said second film side being directed toward one of said first and second opposing press elements, air distribution fabric layer being structured and arranged with said perforated film layer to spread air in said air distribution fabric layer a distance greater than said perforate distance.

28. A method of dewatering a fiber web, the fiber web initially containing water therein, said method comprising the steps of:

providing an air press for dewatering the fiber web, said air press having a nip and an air pressure chamber, said air pressure chamber having air under pressure therein;

providing at least a first fabric and a second fabric for carrying the fiber web through said air press, at least one of said first fabric and said second fabric including:

at least one air distribution fabric layer configured for contacting the fiber web;

a perforated film layer, said perforated film layer being comprised of one of a polyester film and a plastic film, said perforated film layer defining a plurality of holes therethrough separated from each other by a perforate distance, said perforated film layer having a first film side and a second film side, said first film side being one of laminated and attached to one said air distribution fabric layer; and said air distribution fabric layer being structured and arranged with said perforated film layer to spread air in said air distribution fabric layer a distance greater than said perforate distance; and carrying the fiber web between said first fabric and said second fabric through said nip and into said air pressure chamber of said air press;

displacing the water initially contained in said fiber web with the air in said air pressure chamber;

transferring at least some of the displaced water into said at least one of said first fabric and said second fabric; and spreading air in said air distribution fabric layer a distance greater than said perforate distance.

29. The method of claim 28, wherein at least said first fabric is an anti-rewet fabric, said anti-rewet fabric being configured for promoting only a one-way flow of water therethrough, said one-way flow being directed away from the fiber web.

30. A method of dewatering a fiber web, the fiber web initially containing water therein, said method comprising the steps of:

providing an air press for dewatering the fiber web, said air press having a nip and an air pressure chamber, said air pressure chamber having air under pressure therein;

providing a first fabric and a second fabric for carrying the fiber web through said air press;

carrying the fiber web between said first fabric and said second fabric through said nip and into said air pressure chamber of said air press; and displacing the water initially contained in said fiber web with the air in said air pressure chamber;

wherein at least said first fabric is an anti-rewet fabric, said anti-rewet fabric being configured for promoting only a one-way flow of water therethrough, said one-way flow being directed away from the fiber web; and wherein at least one of said first fabric and said second fabric has a three-dimensional structure configured for creating an imprint thereof in the fiber web.

31. A press unit for dewatering a fiber web, said press unit comprising:

first and second opposing press elements, said first press element and said second press element together forming a nip therebetween, said first press element being an enclosure, and said second press element being a counter element positioned opposite said enclosure;

at least one anti-rewet fabric configured for carrying the fiber web through said nip, each said anti-rewet fabric having a first fabric side and a second fabric side, each said anti-rewet fabric including:

at least one air distribution fabric layer, one air distribution fabric layer being configured for contacting the fiber web; and a perforated film layer, said perforated film layer being comprised of one of a polyester film and a plastic film, said perforated film layer having a first film side and a second film side, said first film side being one of laminated and attached to said one air distribution fabric layer, said second film side being directed toward said counter element; and wherein said at least one anti-rewet fabric includes a first anti-rewet fabric, said press unit further comprising a second fabric, said first anti-rewet fabric being configured so as to be arranged between the fiber web and said counter element, said second fabric being configured so as to be arranged between the fiber web and said enclosure, said first anti-rewet fabric and said second fabric have a first permeability and a second permeability, respectively, said first permeability being one of equal to and greater than said second permeability.

* * * * *